US005357860A

United States Patent [19]

Shibata et al.

[11] Patent Number: 5,357,860

[45] Date of Patent: Oct. 25, 1994

[54] CYLINDER PHASE ADJUSTMENT CONTROLLING APPARATUS FOR PRINTING PRESS

[75] Inventors: Satoshi Shibata; Hisaaki Oyoshi, both of Ibaragi, Japan

[73] Assignee: Komori Corporation, Tokyo, Japan

[21] Appl. No.: 36,460

[22] Filed: Mar. 24, 1993

[30] Foreign Application Priority Data

Mar. 27, 1992 [JP] Japan ..... 4-025384[U]

[51] Int. Cl.[5] ..... B41F 13/24

[52] U.S. Cl. ..... 101/248; 101/183; 101/219; 101/231

[58] Field of Search ..... 101/183, 229, 231, 216, 101/248, 181, 212, 219, 230, 232

[56] References Cited

U.S. PATENT DOCUMENTS

| | | | |
|---|---|---|---|
| 2,536,068 | 1/1951 | Funk | 101/248 |
| 3,630,145 | 12/1971 | Leuenberger | 101/248 |
| 3,793,899 | 2/1974 | Bourbonnaud | 101/248 X |
| 3,896,724 | 7/1975 | Muselik | 101/248 |
| 4,085,674 | 4/1978 | Biggar, III | 101/248 |
| 4,457,231 | 7/1984 | Kawaguchi | 101/230 |
| 4,527,788 | 7/1985 | Masuda | 101/248 X |
| 4,638,734 | 1/1987 | Grossmann et al. | 101/248 |
| 4,716,827 | 1/1988 | Wieland et al. | 101/216 |
| 4,735,140 | 4/1988 | Wieland et al. | 101/248 X |
| 4,785,733 | 11/1988 | Hartung et al. | 101/181 |

FOREIGN PATENT DOCUMENTS

| | | | |
|---|---|---|---|
| 0071163 | 4/1983 | Japan | 101/248 |
| 0123664 | 7/1984 | Japan | 101/248 |
| 317341 | 12/1988 | Japan | 101/248 |

*Primary Examiner*—Edgar S. Burr
*Assistant Examiner*—Christopher A. Bennett
*Attorney, Agent, or Firm*—Blakely, Sokoloff, Taylor & Zafman

[57] ABSTRACT

A cylinder phase adjustment controlling apparatus includes a plate cylinder gear, a reference point, a proximity switch, a rotary angle detector, a controller, and a counter. The plate cylinder gear is phase-adjustably fitted on a plate cylinder rotatably axially supported on a frame and coupled to a drive motor. The reference point rotates together with the plate cylinder. The proximity switch is fixed to the frame and detects the reference point. The rotary angle detector outputs a rotation pulse in accordance with rotation of the plate cylinder. The controller automatically controls the phase of the plate cylinder on the basis of an output from the rotary angle detector after the proximity switch detects the reference point. The counter counts the rotation pulse output from the rotary angle detector, and the controller stops rotation of the plate cylinder when the counter counts a predetermined number of rotation pulses corresponding to a control phase amount after a detection output is output from the rotary angle detector.

6 Claims, 2 Drawing Sheets

CYLINDER PHASE ADJUSTMENT CONTROLLING APPARATUS FOR PRINTING PRESS

BACKGROUND OF THE INVENTION

The present invention relates to a cylinder phase adjustment controlling apparatus for various types of printing presses, which performs control to automatically adjust the phase of a cylinder, e.g., a plate cylinder, in the circumferential direction when the specifications of a printed matter are changed or a plate is to be mounted on the cylinder.

A sheet printing press with a reversing mechanism that can be convertibly used both for one-side printing and two-side printing is known as one type of a printing press. FIG. 3 shows the cylinder arrangement of a sheet printing press with a reversing mechanism of this type for explaining an one-side printing operation, and FIG. 4 shows the cylinder arrangement of the same for explaining a two-side printing operation. Referring to FIGS. 3 and 4, a blanket cylinder 2 is provided under and in contact with an upstream plate cylinder 1 on which a plate is mounted. Similarly, a blanket cylinder 4 is provided under and in contact with a downstream plate cylinder 3 on which a plate is mounted. Reference numeral 5 denotes a double-diameter cylinder having a diameter twice that of the cylinder 1 or 3. An impression cylinder 6 and a transfer cylinder 7 are disposed in contact with each other between the double-diameter cylinder 5 and the upstream blanket cylinder 2, and a reversing cylinder 8 and an impression cylinder 9 are disposed in contact with each other between the double-diameter cylinder 5 and the downstream blanket cylinder 4. Reference numeral 10 denotes a paper feed cylinder which is in contact with the upstream impression cylinder 6.

Of these cylinders, the paper feed, impression, transfer, reversing, impression, and double-diameter cylinders 10, 6, 7, 8, 9, and 5 have gripper units (to be referred to as grippers hereinafter) 11, 12, 13, 14, 15, 16, and 17 each made of an openable/closable gripper member and a gripper table. The grippers 11, 12, 13, 14, and 15 are disposed in the outer circumferential gaps of the paper feed, impression, transfer, reversing, and impression cylinders 10, 6, 7, 8, and 9. The grippers 16 and 17 are disposed in the gaps formed at positions of the double-diameter cylinder 5 to equally divide the outer circumferential portion thereof into two portions in the circumferential direction. Reversing grippers 18 having an arrangement the same as those of the above grippers are disposed in the outer circumferential gap of the reversing cylinder 8 to be close to the grippers 14. Chuck heads 19 and 20 are provided at portions of the double-diameter cylinder 5 that equally divide the outer circumferential portion of the double-diameter cylinder into two portions. The chuck heads 19 and 20 are ahead of the grippers 16 and 17, respectively, by predetermined angles in the rotating direction of the cylinder 5 indicated by an arrow in FIG. 4. The respective cylinders are coupled to each other and driven by cylinder gears provided at their shaft end portions, as will be described later. Reference numeral 21 denotes a feed board inclinedly supported between a paper feed unit (not shown) and the paper feed cylinder 10; and 22, paper fed onto the feed board 21.

With this arrangement, in the case of one-side printing shown in FIG. 3, when the respective cylinders are rotated in the directions indicated by arrows, the paper 22 fed from the paper feed unit onto the feed board 21 is gripped by the grippers 11 of the paper feed cylinder 10, conveyed by a predetermined angle by the rotation of the paper feed cylinder 10, transferred to the gripper 12 of the impression cylinder 6, and wound on the circumferential surface of the impression cylinder 6. Since an image formed on the plate surface of the plate cylinder 1 is transferred to the blanket cylinder 2, this image is transferred to the paper 22 passing between the blanket and impression cylinders 2 and 6, thereby performing printing of the first color.

The printed paper 22 is transferred from the grippers 12 of the impression cylinder 6 to the grippers 13 of the transfer cylinder 7, then to the grippers 16 or 17 of the double-diameter cylinder 5, and wound on the upper circumferential surface of the double-diameter cylinder 5. As the double-diameter and reversing cylinders 5 and 8 are rotated, the wound paper 22 is transferred from the grippers 16 or 17 to the opposite grippers 14, and to the grippers 15 of the impression cylinder 9. At this time, since the image formed on the plate surface of the plate cylinder 3 is transferred to the blanket cylinder 4, this image is transferred to the paper 22 passing between the blanket and impression cylinders 4 and 9, thereby performing printing of the second color. In this case, since the image from the upstream blanket cylinder 2 and the image from the downstream blanket cylinder 4 are transferred on the same surface of the paper 22, one-side printing is performed. The paper 22 subjected to one-side printing is conveyed to a following printing unit or paper discharge unit (not shown).

The operation of two-side printing will be described with reference to FIG. 4. When one-side printing is switched to two-side printing, the whole upstream cylinder group including the double-diameter cylinder 5 is phase-adjusted by a phase adjusting unit (to be described later) with respect to the reversing cylinder 8, so that a state of FIG. 3 wherein the grippers 17 and 14 oppose each other is changed to a state of FIG. 4 wherein the reversing grippers 18 oppose the chuck head 19 or 20. Also, the operation timings of the cam mechanisms for opening/closing the grippers 16 and 17 are adjusted. When the respective cylinders are rotated to start the printing operation, the paper 22 having a printed surface is transferred to the grippers 16 or 17 of the double-diameter cylinder 5, in the same manner as in the case of one-side printing, and wound on the upper circumferential surface of the double-diameter cylinder 5.

In this case, after the grippers 16 or 17 pass over the contact points of the double-diameter and reversing cylinders 5 and 8, the two cylinders 5 and 8 continue rotation. Then, the paper 22 wound on the upper circumferential surface of the double-diameter cylinder 5 is wound on the lower circumferential surface of the double-diameter cylinder 5, as indicated by a reference symbol 22A in FIG. 4. While the paper trailing end of the paper 22A is located at the contact point of the double-diameter and reversing cylinders 5 and 8, the reversing gripper 18 of the reversing cylinder 8 is opened and closed. Thus, the paper trailing end of the paper 22A is gripped by the reversing grippers 18 by the cooperation of the reversing grippers 18 and the opposite chuck head 19 or 20. As a result, the lower surface of the paper 22A is brought into contact with the circumferential surface of the reversing cylinder 8, and the upper surface of the paper 22A is brought into contact with the circumferential surface of the impression cylinder 9. Printing is performed on the lower surface of the paper 22A passing between the blanket and impression cylinders 4 and 9. Since printing has been performed on the upper surface of the paper 22 by the blanket cylinder 2, two-side printing is eventually performed.

The conventional phase adjusting unit for adjusting the phases of the upstream cylinder group including the double-diameter cylinder 5 when one-side printing is switched to two-side printing, as described above, will be described. Referring to FIG. 3, the respective cylinders are coupled and driven by cylinder gears provided to their shaft end portions. Of these cylinder gears, the cylinder gear of the reversing cylinder 8 is constituted by stationary and pivot gears that are coupled to each other to be freely fixed or released with or from each other. The stationary gear of the cylinder gear of the reversing cylinder 8 is fixed to the end shaft of the reversing cylinder 8 and meshed with the cylinder gear of the impression cylinder 9, and the rotational gear thereof is meshed with the cylinder gear of the double-diameter cylinder 5.

With this arrangement, when one-side printing is to be switched to two-side printing, the stationary and pivot gears are released from each other, and the pivot gear is pivoted by, e.g., a handle. Then, the cylinders 5, 7, 6, 2, 1, and 10 of the upstream printing cylinder group including the double-diameter cylinder 5 are simultaneously pivoted by meshing of their cylinder gears, and their phases in the circumferential directions with respect to the reversing cylinder 8 are adjusted. Then, the stationary and pivot gears of the cylinder gear of the reversing cylinder 8 are fixed, thereby completing phase adjustment.

In the case of two-side printing, the position of a pattern printed on the upper surface of the paper 22 and the position of a pattern printed on the lower surface of the paper 22 are misregistered from each other depending on the printing or mounting position of the plate. Furthermore, in two-side printing, printing is sometimes performed by intentionally misregistering the pattern position of the upper surface and the pattern position of the lower surface of the paper 22. For this purpose, as shown in FIG. 3, a cylinder gear 23 of the plate cylinder 1 is fitted on an end shaft 1*a* thereof by a bolt or the like to be freely fixed or released with or from it, and the cylinder gear 23 is meshed with a cylinder gear 25 of the impression cylinder 6 through a cylinder gear 24 of the blanket cylinder 2. The cylinder gear 25 of the impression cylinder 6 is meshed with a gear 26, and a gear 27 integrally fixed with the gear 26 is meshed with a gear 29 fixed to a rotary encoder 28 for outputting a rotation pulse to a controller (not shown).

With this arrangement, when the bolt for fixing the cylinder gear 23 of the plate cylinder 1 is loosened to pivot and adjust the plate cylinder 1 and this fixing bolt is fixed, vertical registration of the plate is adjusted. Also, for example, when the plate cylinder 1 is to be stopped at a predetermined position for plate exchange or the like, the plate cylinder 1 is driven by a motor, so that the stop position of the plate cylinder 1 is controlled with reference to an output from the rotary encoder 28 connected to the controller.

In the conventional cylinder phase adjustment controlling apparatus, however, the phases of the cylinders are adjusted with reference to the output from the rotary encoder 28, as described above. Therefore, when phase adjustment is performed by changing the phases of, e.g., the plate cylinder 1 and the cylinder gear 23, the phase of the plate cylinder 1 cannot be detected from the output from the rotary encoder 28, and the stop position of the plate cylinder 1 is shifted from the preset position by a moving adjustment amount. Then, the phase adjustment of the plate cylinder 1 cannot be controlled at a timing of the printing press side, so that the phase adjustment precision is degraded, and the preparation time is prolonged by readjustment, resulting in degradation in operability of the machine. These problems arise not only in the sheet printing press with the reversing mechanism described above, but also in a conventional one-side multi-color printing press, since the phases of the plate cylinder and cylinder gears are shifted from each other for registration of different colors.

SUMMARY OF THE INVENTION

It is an object of the present invention to provide a cylinder phase adjustment controlling apparatus for a printing press capable of controlling phase adjustment on the basis of a cylinder reference regardless of the timing of the printing press side.

It is another object of the present invention to provide a cylinder phase adjustment controlling apparatus for a printing press in which the quality of a printed matter and the operability of the printing press are improved.

In order to achieve the above objects, according to the present invention, there is provided a cylinder phase adjustment controlling apparatus comprising a first gear phase-adjustably fitted on a cylinder rotatably axially supported on a frame and coupled to a drive motor, a to-be-detected body rotating together with the cylinder, detecting body, fixed to the frame, for detecting the to-be-detected body, a rotary angle detector for outputting a rotation pulse in accordance with rotation of the cylinder, and control means for automatically controlling a phase of the cylinder on the basis of an output from the rotary angle detector after the detecting body detects the to-be-detected body.

DESCRIPTION OF THE PREFERRED EMBODIMENT

Figure 1:
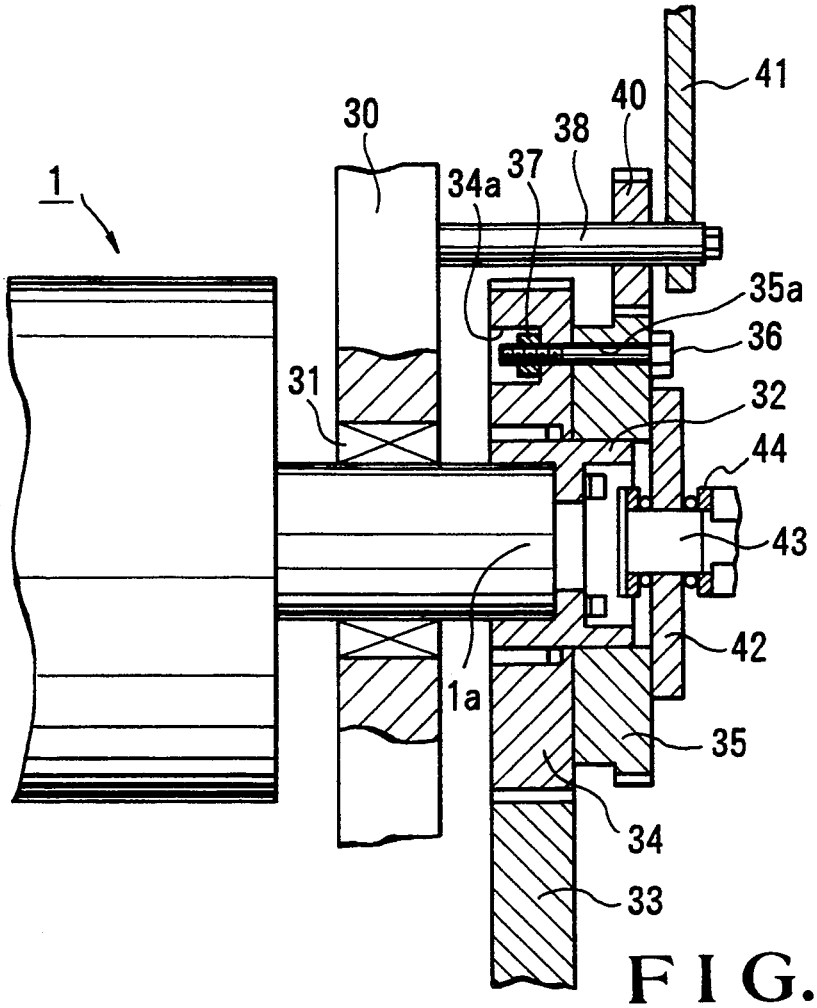
FIG. 1 is a longitudinal sectional view showing the shaft end portion of the plate cylinder of a sheet printing press with a reversing mechanism according to the present invention.
Figure 2:
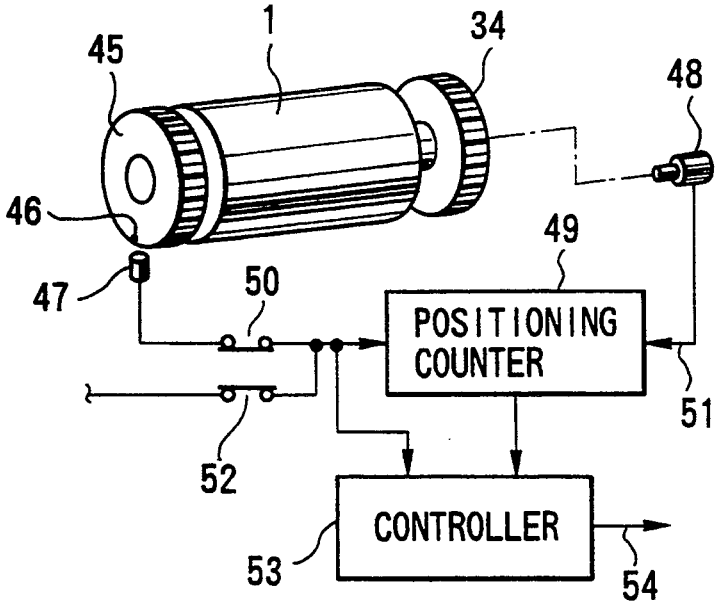
FIG. 2 includes a perspective view showing the plate cylinder shown in FIG. 1 and a schematic view showing the arrangement of a phase adjustment controlling apparatus.

FIGS. 1 and 2 show an embodiment in which the present invention is applied to a sheet printing press with a reversing mechanism, in which FIG. 1 shows the end shaft portion of a plate cylinder, and FIG. 2 shows the plate cylinder and the arrangement of a phase adjustment controlling apparatus. Since the cylinder arrangement of the printing press is the same as those shown in FIGS. 3 and 4, a detailed description thereof will be omitted.

Figure 3:
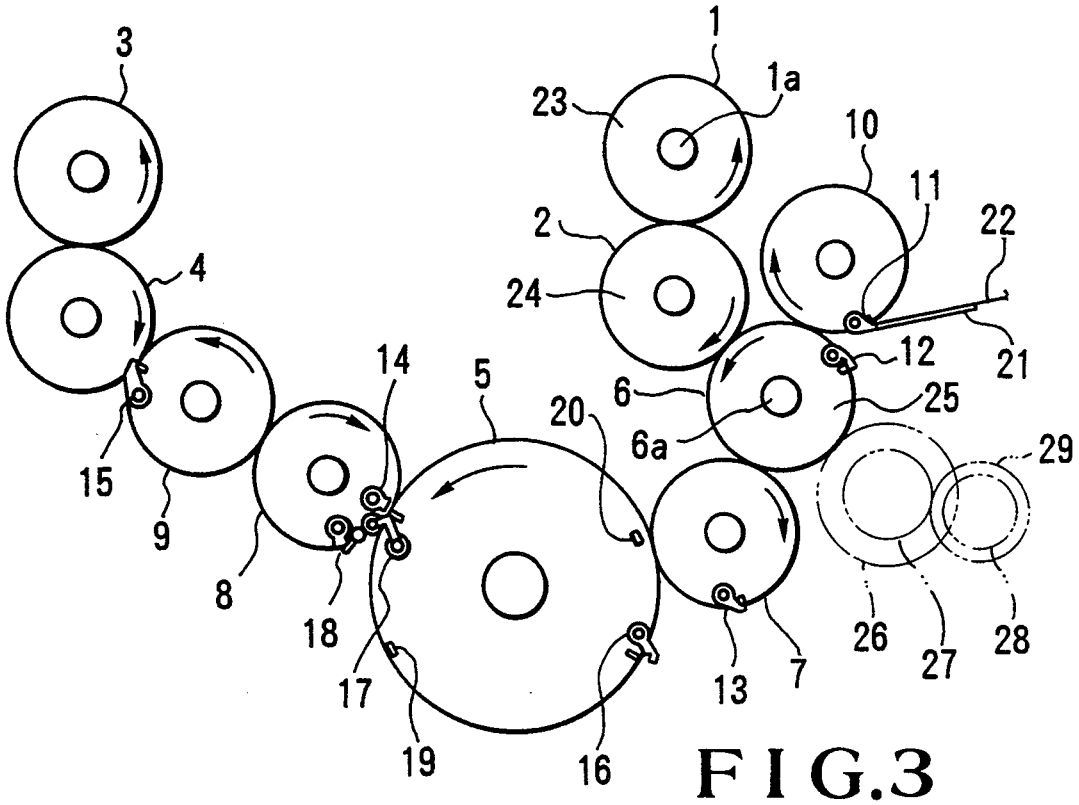
FIG. 3 is a view showing a cylinder arrangement for explaining the one-side printing operation of a sheet printing press with a reversing mechanism commonly employed in the prior art and the present invention.
Figure 4:
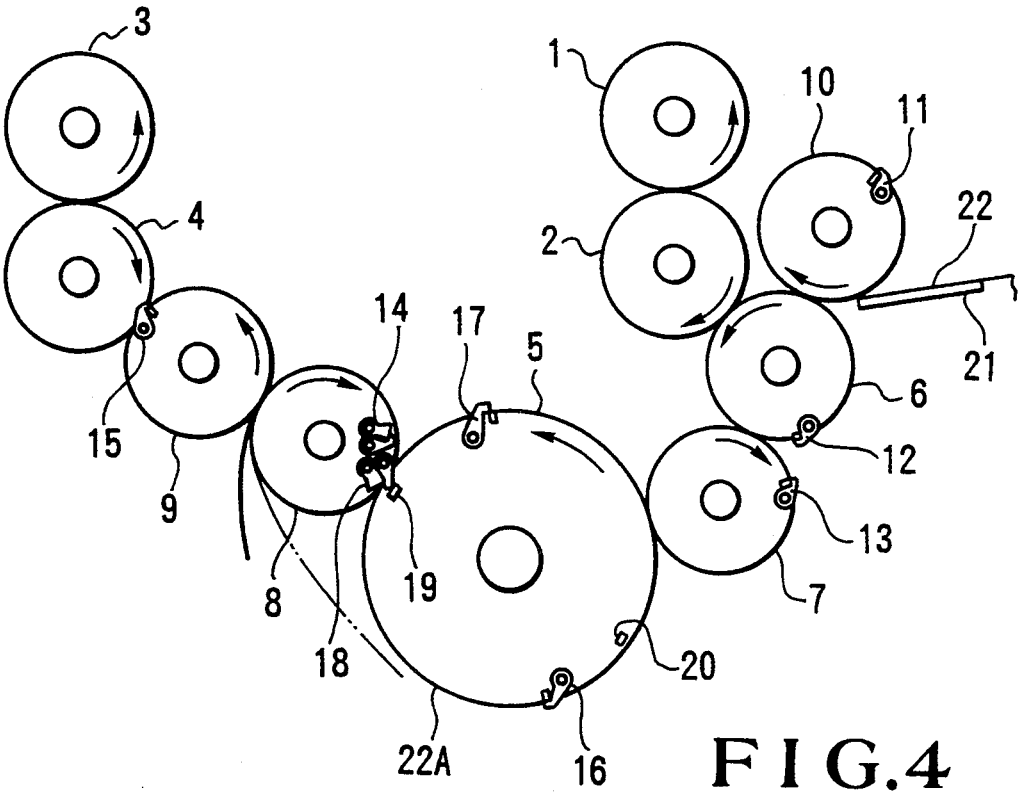
FIG. 4 is a view showing a cylinder arrangement for explaining the two-side printing operation of the sheet printing press with the reversing mechanism commonly employed in the prior art and the present invention.

As shown in FIGS. 1 and 2, a plate cylinder 1 having a cylinder arrangement shogun in FIGS. 3 and 4 is rotatably axially supported by a frame 30 through a bearing 31. A plate cylinder gear 34 meshing with a blanket cylinder gear 33 fixed to the end shaft of a blanket cylinder 2 is rotatably fitted in a cylindrical gear holder 32 fixed to an end shaft 1*a* of the plate cylinder 1 by a bolt. A plurality of arcuated elongated holes 34*a* having steps in the axial direction are formed in the inner surface of the plate cylinder gear 34, i.e., in the surface of the plate cylinder gear 34 facing the plate cylinder 1. An adjustment gear 35 is mounted on the outer side of the plate cylinder gear 34 and fixed by the gear holder 32. The phase of the adjustment gear 35 relative to that of the plate cylinder gear 34 can be movably adjusted in the circumferential direction by clamping the screw portion of a bolt 36 inserted in a bolt hole 35*a* of the adjustment gear 35 in an arbitrary arcuated elongated hole 34*a*.

A gear 40 meshing with the adjustment gear 35, and a handle 41 are integrally fixed and fitted on a stud 38, provided to stand on the counter plate cylinder side of the frame 30, to be pivotal and movable in the axial direction. After the bolt 36 is loosened, the gear 40 is axially moved, together with the handle 41, to the position shown in FIG. 1 to be meshed with the adjustment gear 35, and the handle 41 is pivoted. Then, the phase of the plate cylinder 1 integral with the adjustment gear 35 and the phase of the plate cylinder gear 34 relative to each other can be adjusted through the gear 40 in the circumferential direction. Reference numeral 42 denotes a disk fixed on the outer side of the adjustment gear 35. The thrust of a shaft portion 43 of the disk 42 is supported by a thrust bearing 44 of the printing press so that the disk 42 is rotatably axially supported.

In this apparatus, as shown in FIG. 2, an L-shaped reference point 46 constituted by, e.g., an L-shaped reflecting plate is fixed on the outer circumferential portion of a stationary gear 45 of the plate cylinder 1 and serves as a body to be detected. A proximity switch 47 constituted by, e.g., a photoelectric sensor is provided on the printing press and serves as a detecting body for moving close to the rotating locus of the reference point 46 and detecting light reflected by the reference point 46. The output of the proximity switch 47 is connected to the reset input of a positioning counter 49 through a selector switch 50. A rotary encoder 48 for outputting a large number of rotation pulses per revolution of the plate cylinder 1 is fixed on the printing press and serves as a rotary angle detector. The output of the rotary encoder 48 is connected, through a line 51, to the count input of the positioning counter 49 indicating the rotational angle (phase). The positioning counter 49 is connected to a controller 53, and the controller 53 outputs a control signal 54, e.g., a stop signal, to the printing press. Reference numeral 52 denotes a line for performing phase adjustment of other plate cylinders.

The operation of the sheet printing press with the reversing mechanism having the above arrangement will be described. As the one-side printing operation and the two-side printing operation are described above, a repeated description thereof will be omitted. Only a switching operation between one-side printing and two-side printing will be described with reference to FIGS. 3 and 4. In order to perform the switching operation between one-side printing and two-side printing, the stationary and pivot gears fixed to the shaft end portion of a reversing cylinder 8 are released from each other, and the pivot gear is pivoted by, e.g., a handle. Then, cylinders 5, 7, and 6, the gears 2 and 1, and a gear 10 of the upstream printing cylinder group including a double-diameter cylinder 5 are simultaneously rotated upon meshing of their cylinder gears, and their phases in the circumferential direction with respect to that of the reversing cylinder 8 are adjusted. Then, the stationary and pivot gears are fixed with each other, thereby completing phase adjustment of the printing press.

In this state, when the phase of the plate cylinder 1 is to be singly adjusted, the bolt 36 is loosened, and the handle 41 is pivoted to pivot the gear 40 integral with it. Then, the phases of the plate cylinder and adjustment gears 34 and 35 relative to each other are changed in the circumferential direction while moving the bolt 36 in the corresponding arcuated elongated hole 34*a* of the plate cylinder gear 34, so that the phase of the plate cylinder 1 integral with the adjustment gear 35, and the phase of the plate cylinder gear 34 relative to each other are adjusted in the circumferential direction. After adjustment is completed, the bolt 36 is clamped to fix the plate cylinder and adjustment gears 34 and 35.

After the phase adjustment of only the plate cylinder 1 is performed, in the automatic phase control operation of the plate cylinder 1 necessitated by, e.g., plate mounting, the controller 53 detects the reference point 46 from the output from the proximity switch 47, and moves the plate cylinder 1 to the preset position with reference to the position of the reference point 46 on the basis of the output from the rotary encoder 48. More specifically, after the controller 53 detects the reference point 46, the positioning counter 49 counts a predetermined number of rotation pulses corresponding to the phase adjustment amount at the timings of the printing press side. Then, the controller 53 detects that the count of the positioning counter 49 coincides with the count stored in advance, and outputs a control signal 54 to stop rotation of the plate cylinder 1. Hence, since the plate cylinder 1 and the reference point 46 will not be deviated from each other even when the phase of the plate cylinder 1 is singly adjusted in the vertical direction, accurate phase control can be performed by detecting the reference point 46. In this case, the positioning counter 49 is reset by the output from the proximity switch 47, and control can be easily performed by setting the reference position of the automatic phase adjustment operation of the plate cylinder 1 necessitated by, e.g., plate mounting. More specifically, since the positioning counter 49 after being reset functions as the detector for detecting the rotational angle from the reference position, the count of the gear 40 directly indicates the phase amount. The count to be stored in correspondence with the phase adjustment amount with reference to the preset position may be fixed, or may be stored after the timing of the printing press is adjusted.

In this embodiment, the reference point 46 is fixed on the end face of the stationary gear 45. However, the reference point 46 can be integrally fixed on the end face of the plate cylinder 1. In this embodiment, the reference point 46 serving as the body to be detected is fixed on the side surface of the upstream plate cylinder 1 in the paper convey direction. However, the reference point 46 can be fixed to the side surface of the downstream plate cylinder 3 or the like. In this embodiment, the present invention is applied to the plate cylinder of the sheet printing press with the reversing mechanism. However, the present invention is not limited to this, and can similarly be applied to a plate cylinder in a case wherein the plate cylinder is to be pivoted to a selected position and stopped for o plate exchange or the like. The cylinder to which the present invention is applied is not limited to a plate cylinder, but can similarly be applied to any other cylinder while obtaining the same effect as far as it is a cylinder the phase of which is to be changed.

In this embodiment, the gear 40 is pivoted by manually rotating the handle 41. However, the gear 40 can be rotated by a drive unit, e.g., a motor.

As is apparent from the above description, according to the present invention, in a printing press having a cylinder rotatably axially supported on the frame and a gear rotation-adjustably fitted on this cylinder and coupled to the drive motor side, a body to be detected is integrally fixed on the cylinder, a detecting body for detecting this to-be-detected body is fixed on the printing press, and the detection output from the detecting body and the output from a rotary encoder are input to a control means. Therefore, phase adjustment of the cylinder can be performed without being influenced by the adjustment amount of the cylinder in the circumferential direction which is independent of the adjustment of the timing of the printing press. Thus, accurate control can be quickly performed, thereby improving the quality of the printed matter and the operability of the printing press.

What is claimed is:

1. A cylinder phase adjustment controlling apparatus in a printing press having a frame, a drive motor, a cylinder rotatably axially supported on the frame and coupled to the drive motor, the cylinder having an end face, the apparatus comprising:

a first gear phase-adjustably fitted on the cylinder;

a to-be-detected body rotating together with said cylinder, the to-be-detected body fixed on the end face of the cylinder in such a location as to rotate in a synchronous phase with the cylinder;

detecting means, fixed to said frame, for detecting said to-be-detected body;

a rotary angle detector for outputting a rotation pulse in accordance with rotation of said cylinder;

counter means for counting a rotation pulse output from said rotary angle detector, the counter means being reset by a detection output from said detecting means;

a second gear fixed to said cylinder;

a plurality of auxiliary cylinders, each auxiliary cylinder rotated according to a rotating movement of the second gear to adjust print timings of the printing press; and control means for automatically controlling a phase of said cylinder on the basis of an output from said rotary angle detector after said detecting means detects said to-be-detected body, wherein the control means stops rotation of the cylinder at a preset position for plate replacement in the cylinder when the counter, after being reset, counts a predetermined number of rotation pulses corresponding to a control phase amount after a detection output is output from said detecting means, wherein the phase adjustment of the cylinder is independently performed by the cylinder phase adjustment controlling apparatus after completion of a printing timing adjustment of the cylinder and the auxiliary cylinders.

2. An apparatus according to claim 1, wherein said rotary angle detector comprises a rotary encoder.

3. An apparatus according to claim 1, wherein the to-be-detected body has a rotating locus, and said detecting means comprises a proximity switch, disposed close to the rotating locus of said to-be-detected body, for detecting said to-be-detected body coming close thereto during rotation.

4. An apparatus according to claim 1, further comprising a member with an end face rotating together with the cylinder, wherein said to-be-detected body is fixed on the end face of the member.

5. An apparatus according to claim 1, further comprising cylinder phase adjusting means for releasing engagement between said first and second gears for singly adjusting the phase of said cylinder.

6. An apparatus according to claim 1, further comprising third gears coupled to the auxiliary cylinders and meshed with each other and with the second gear, one of the third gears being meshed with the rotary angle detector, the rotation pulses being output on the basis of a rotation movement of one of the third gears.

* * * * *